US007775264B2

(12) United States Patent
Andersson et al.

(10) Patent No.: US 7,775,264 B2
(45) Date of Patent: Aug. 17, 2010

(54) PLATE HEAT EXCHANGER

(75) Inventors: Sven Andersson, Hässleholm (SE); Hans Andre, Helsingborg (SE); Tomas Dahlberg, Helsingborg (SE)

(73) Assignee: SWEP International AB, Landskrona (SE)

( * ) Notice: Subject to any disclaimer, the term of this patent is extended or adjusted under 35 U.S.C. 154(b) by 1055 days.

(21) Appl. No.: 10/582,543

(22) PCT Filed: Nov. 24, 2004

(86) PCT No.: PCT/SE2004/001714

§ 371 (c)(1),
(2), (4) Date: Jun. 28, 2006

(87) PCT Pub. No.: WO2005/057118

PCT Pub. Date: Jun. 23, 2005

(65) Prior Publication Data

US 2007/0089871 A1 Apr. 26, 2007

(30) Foreign Application Priority Data

Dec. 10, 2003 (SE) ..... 0303307

(51) Int. Cl.
*F28D 9/00* (2006.01)

(52) U.S. Cl. ..... 165/167; 165/DIG. 364

(58) Field of Classification Search ..... 165/167
See application file for complete search history.

(56) References Cited

U.S. PATENT DOCUMENTS

| | | | | |
|---|---|---|---|---|
| 5,327,958 | A * | 7/1994 | Machata et al. | 165/167 |
| 5,727,623 | A * | 3/1998 | Yoshioka et al. | 165/113 |
| 5,988,269 | A | 11/1999 | Karlsson et al. | |
| 6,142,221 | A | 11/2000 | Johansson | |
| 6,164,371 | A * | 12/2000 | Bertilsson et al. | 165/140 |
| 6,305,466 | B1 | 10/2001 | Andersson et al. | |
| 2002/0026999 | A1 * | 3/2002 | Wu et al. | 165/167 |
| 2004/0206487 | A1 * | 10/2004 | Blomgren | 165/167 |

FOREIGN PATENT DOCUMENTS

| | | |
|---|---|---|
| DE | 94 05 012 U1 | 5/1994 |
| JP | 02-25491 | 10/1990 |
| JP | 06-117783 | 4/1994 |
| JP | 10-288479 | 10/1998 |
| WO | WO 94/14021 A1 | 6/1994 |
| WO | WO 99/30099 | 6/1999 |
| WO | WO 03/006911 A1 | 1/2003 |
| WO | WO 03/031896 A1 | 4/2003 |

* cited by examiner

*Primary Examiner*—Allen J Flanigan
(74) *Attorney, Agent, or Firm*—Breiner & Breiner, L.L.C.

(57) ABSTRACT

A plate heat exchanger comprising plates (21, 31) interconnected by soldering and adapted to exchange heat between a high and a low temperature fluid may be designed to improve the cooling of the parts of the plates located near inlets (3) for the high temperature fluid by providing separate fluid channels (23, 26) in pairs of plates (21, 31) guiding low temperature fluid, said separate channels (23, 26) at least partly surrounding said inlets (3) for the high temperature fluid.

6 Claims, 12 Drawing Sheets

X-X

PLATE HEAT EXCHANGER

The present invention relates to a plate heat exchanger adapted to exchange heat between at least one high temperature fluid and at least one cooling fluid comprising a plurality of stacked heat exchanger plates, each of which comprising: (a) an inlet opening for the high temperature fluid, (b) an outlet opening for a cooling fluid, (c) an outlet opening for said high temperature fluid and (d) an inlet opening for the cooling fluid, the stacked heat exchanger plates limiting channels for at least two heat exchanging fluids, and in which pairs of plates limiting channels for a cooling fluid are soldered together along-contact areas to form flanges extending into the inlet of the flow of high temperature fluid.

The said high temperature fluid may be a gas flow generated by combustion of a fuel such as oil or natural gas, and the cooling fluid may be a flow of water used for heating dwelling houses. It is certainly desired to design the heat exchanger as small as possible and at a low manufacturing cost. This may be obtained by making the exchanger able to receive the flow of heating gas at a very high temperature.

A limit of the temperature of the hot gases used is set e.g. by the use of soldering material for interconnecting adjacent heat exchanger plates around port holes through which the hot gases are passed. The soldering material—often copper or nickel—is liable to fatigue when exposed to rapidly changing temperatures i.e. exposed to high temperature gradients. Even the material used in the heat exchanger plates—generally steel—is liable to fatigue when exposed to large and rapid variations in temperatures. Therefore, the life of the exchanger will generally decrease with increasing temperature of the high temperature fluid passing the exchanger.

The object of the present invention is to design a plate heat exchanger of the type referred to above in which the maximum temperature gradients of the material in the exchanger may be substantially reduced and in which the life of the exchanger may be substantially prolonged.

According to the present invention this is obtained thereby that two separate channels for a cooling fluid are provided adjacent to said contact areas forming a flange extending into the flow of said high temperature fluid passing through the inlet opening, the said two separate channels for the cooling fluid being provided with a common inlet and with a common outlet, the said common inlet being located at a higher flow pressure position than that of the said common outlet, one of the said channels being partly limited by a pressed ridge in one of the said plates forming said pairs of plates limiting channels for the cooling fluid, the said pressed ridge being adapted to contact a corresponding ridge on the other plate in said pair of plates, the said one channel adjacent to the said pressed ridge having less height than the said pressed ridge.

Thus it is ensured that a steady flow of cooling medium will be passed between the plates which are interconnected by soldering along areas bordering the inlet openings in the plates for the high temperature flow, said flow of cooling medium being close to the soldered joints and to the plate material exposed to maximum temperature gradients in the exchanger.

The invention will be described in more detail reference being made to the accompanying drawing in which FIG. 1 schematically and in plan view shows a plate of a prior art heat exchanger adapted to heat cold water by hot combustion gases.

FIG. 2 schematically and in plan view shows a plate of a heat exchanger according to the present invention.

FIG. 3 schematically and in plan view shows a heat exchanging plate adapted to be placed on top of a plate of the type shown in FIG. 2 in a heat exchanger according to the present invention.

FIG. 4 shows a vertical section through a heat exchanger according to the present invention said section being taken along the lines X-X in FIGS. 2 and 3.

FIG. 5 as an exploded view shows flow defining plates as those shown in FIG. 4.

Figure 1:
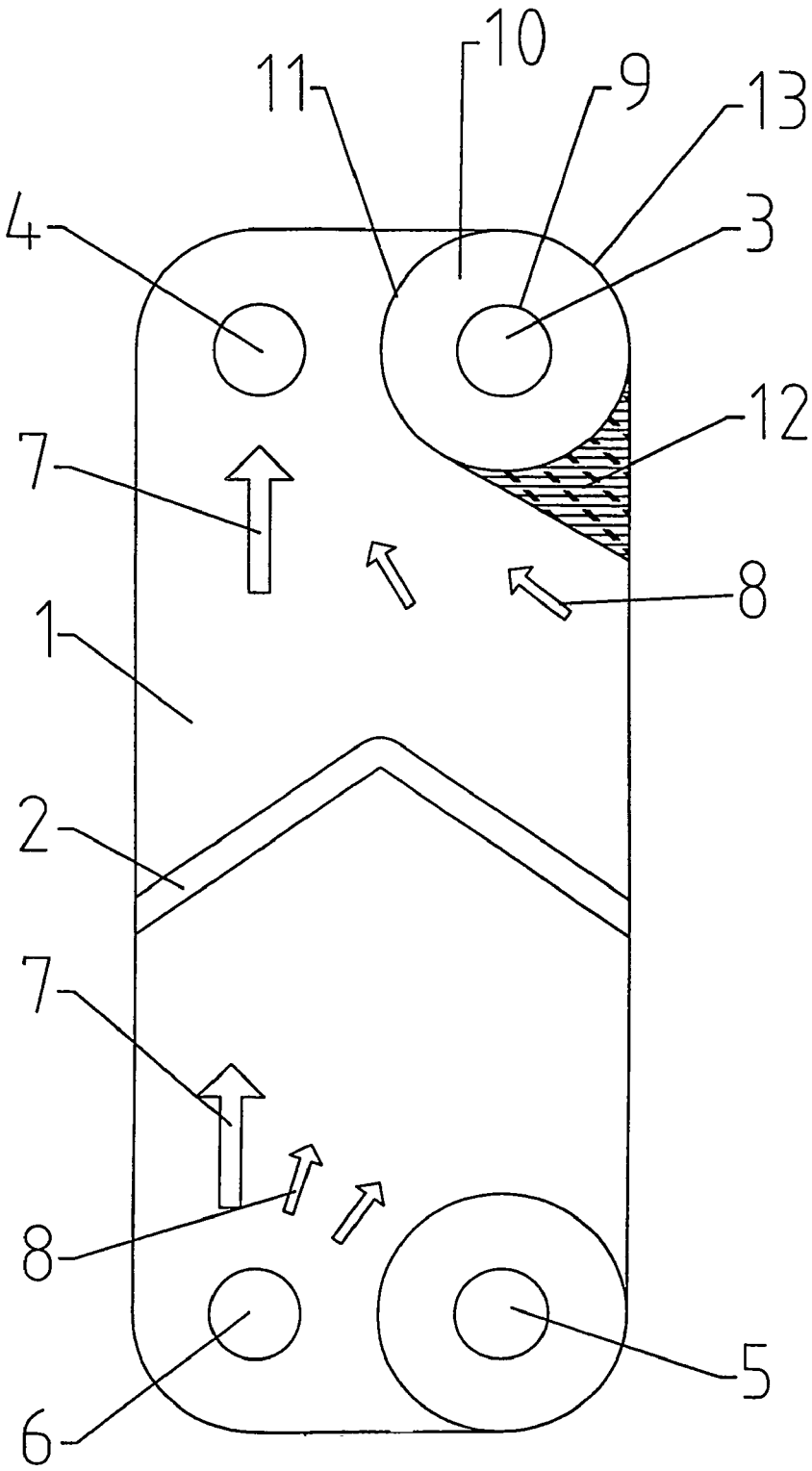

A known heat exchanger plate 1 shown in FIG. 1 is provided with a pressed chevron pattern of ridges and depressions—schematically shown and designated by 2. The plate 1 is shown from above and the upper side is adapted to limit a flow of cooling water, whereas its other side is adapted to limit a flow of a hot gas, e.g. having a temperature of 1300° C. The plate 1 is provided with four holes 3-6, the hole 3 being an inlet for the high temperature fluid, the hole 4 being an outlet for the cooling water, the hole 5 being an outlet for the high temperature fluid and the hole 6 being an inlet for the cooling water.

The flow of cooling water along the plate 1 has been indicated by a plurality of arrows 7 and 8—the larger arrows 7 indicating directions of a greater mass flow, whereas the arrows 8 indicate the direction of a substantially minor mass flow. The hole 3 is limited by a circular edge 9 of the plate 1 which has been soldered to an adjacent heat exchanger plate—not shown in FIG. 1—along a ring shaped area 10 between the edge 9 and a line 11 bordering a corner 13 of the plate 1. The ring shaped area 10 of the two plates soldered together will form a flange which on both sides are contacted by hot gases and cooled by conducting heat to adjacent plate parts exposed to cooling water.

However, the flow of cooling water is very slow along a part 12 of the plate 1—shown by hatching in FIG. 1. Therefore, the soldering material—copper or nickel—used to interconnect the plates at the area 10 and the plate material in the area 10 will reach such high temperature exceeding the limit set by the soldering material and often in connection with a high temperature gradient in the material of the heat exchanger plates. This may cause fatigue of material and thus substantially reduce the life time of the heat exchanger.

Figure 2:
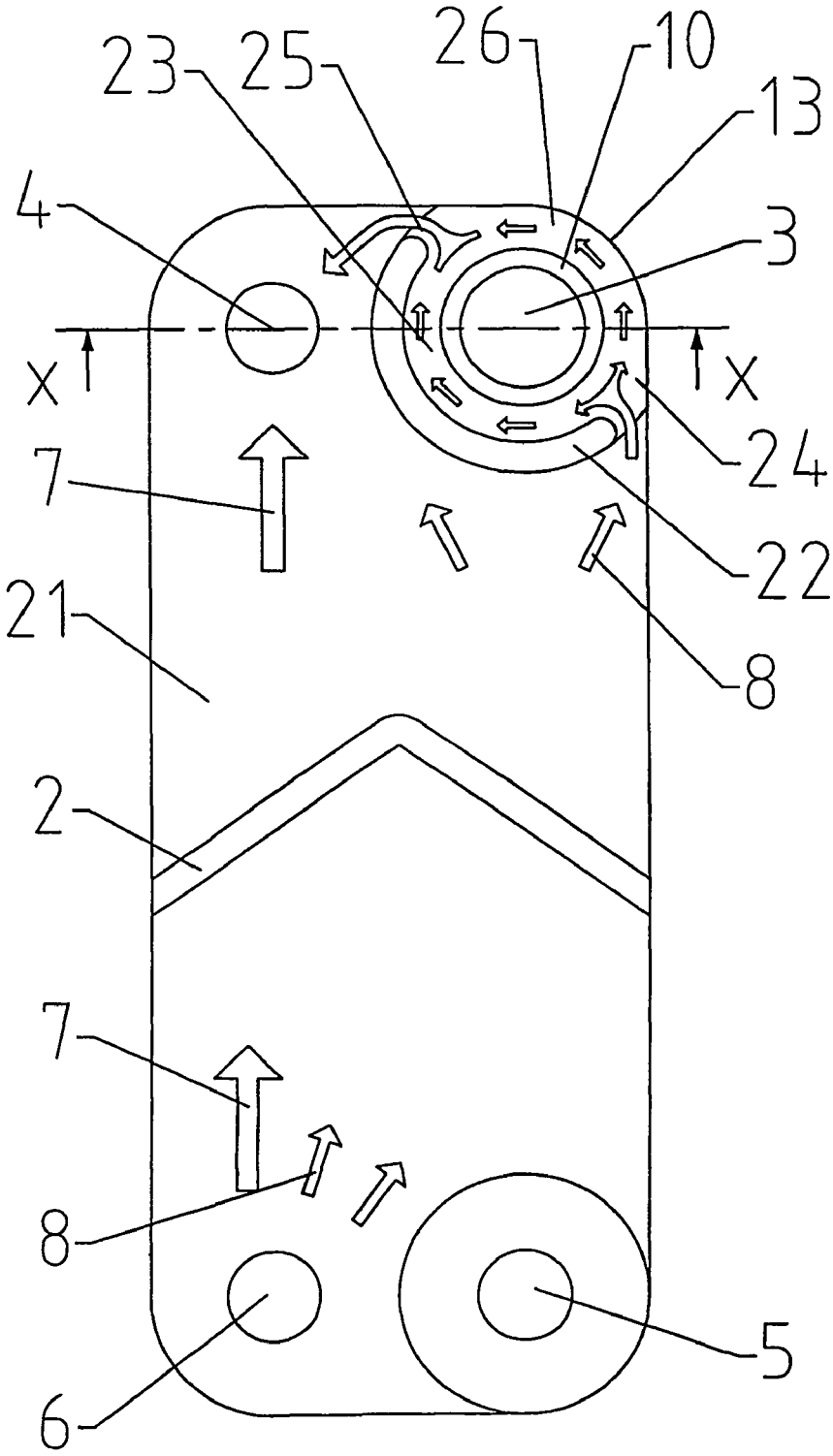
Figure 3:
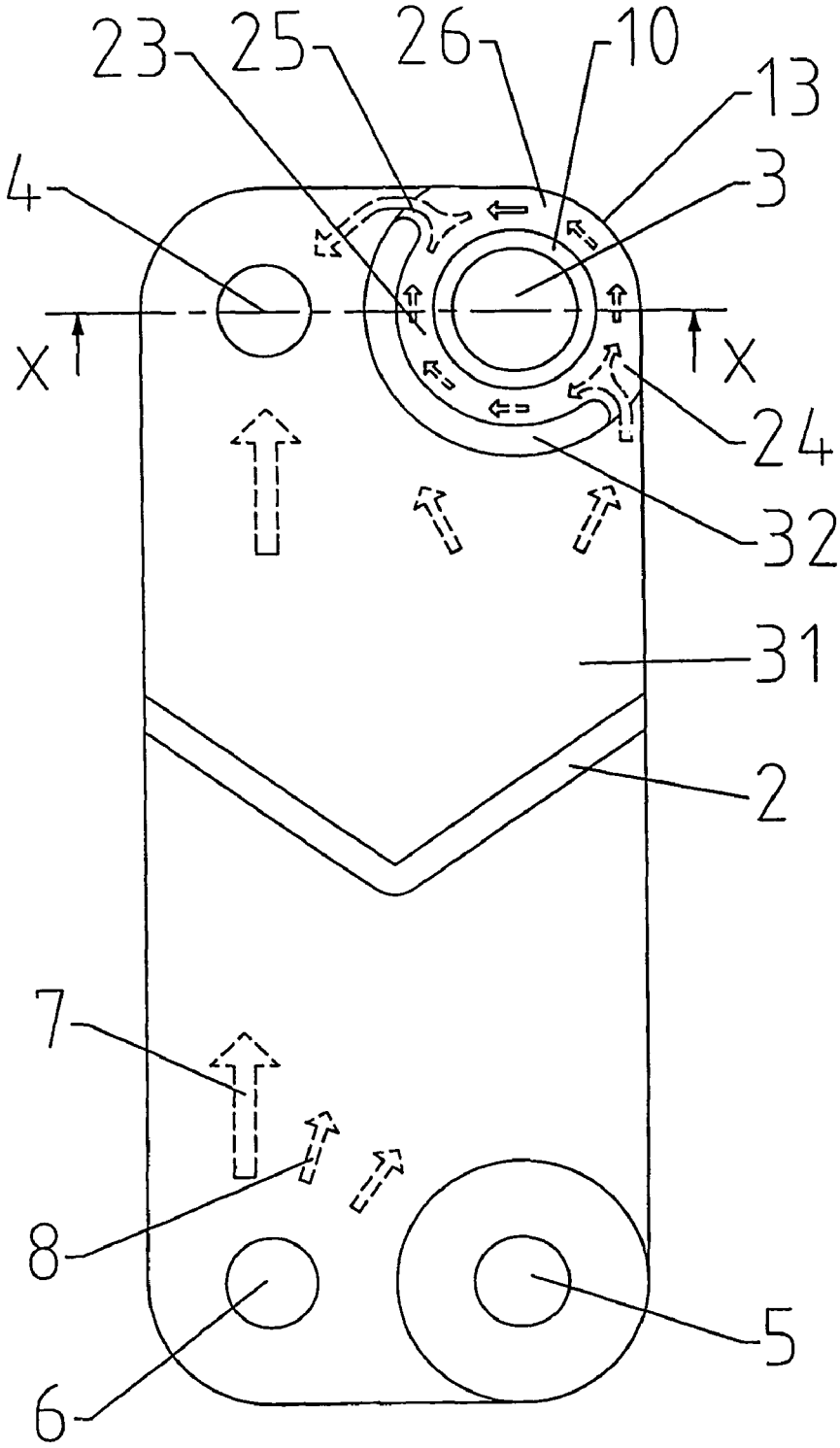

The FIGS. 2 and 3 show how this drawback may be avoided to a large extent by using a design according to the present invention.

FIG. 2 shows a heat exchanger plate 21 to be used in a heat exchanger according to the present invention. Corresponding details and features already shown in FIG. 1 have been provided with corresponding reference numbers. The plate 21 is shown from above and the cooling water is passing on its upper side while the hot gas is flowing along its lower side. A ridge 22 formed as a part of a ring has been pressed upwardly to the level of the tops of the ridges 2. The top of said ridge 22 contacts the top of a corresponding ridge in an adjacent plate—explained below with reference to FIG. 3—and limits a separate channel 23 located between the ridge 22 and the said flange at a part of the ring shaped area 10. As shown in FIG. 2 the channel 23 has an inlet 24 remote from the outlet opening 4 for the flow of cooling water and an outlet 25 near said outlet opening 4. A part of the flow of cooling water entering the inlet 24 of the channel 23 will pass through a channel 26 between said flange at a part of the ring shaped area 10 and the adjacent corner 13 of the plate 21. It will be understood that the pressure of the cooling fluid at the position of the inlet 24 will be higher than that of the outlet 25, thus ensuring a flow through the channels 23 and 26.

FIG. 3 shows a heat exchanger plate 31 to be placed on the top of the plate 21 shown in FIG. 2. FIG. 3 shows the plate 31 from above and the cooling water will pass along its lower side. As is common practice in the art the chevron pattern 2 of the plate 31 is directed opposite to that of the plate of FIG. 2. The ridge having shape as a part of a ring and mentioned above has been designated by 32 and is downwardly pressed to contact the top of the ridge 22 shown in FIG. 2. The two curved ridges 22 and 32 will, therefore, together limit the channel 23. The channel inlet 24 and the channel outlet 25 are shown again in FIG. 3.

Figure 4:
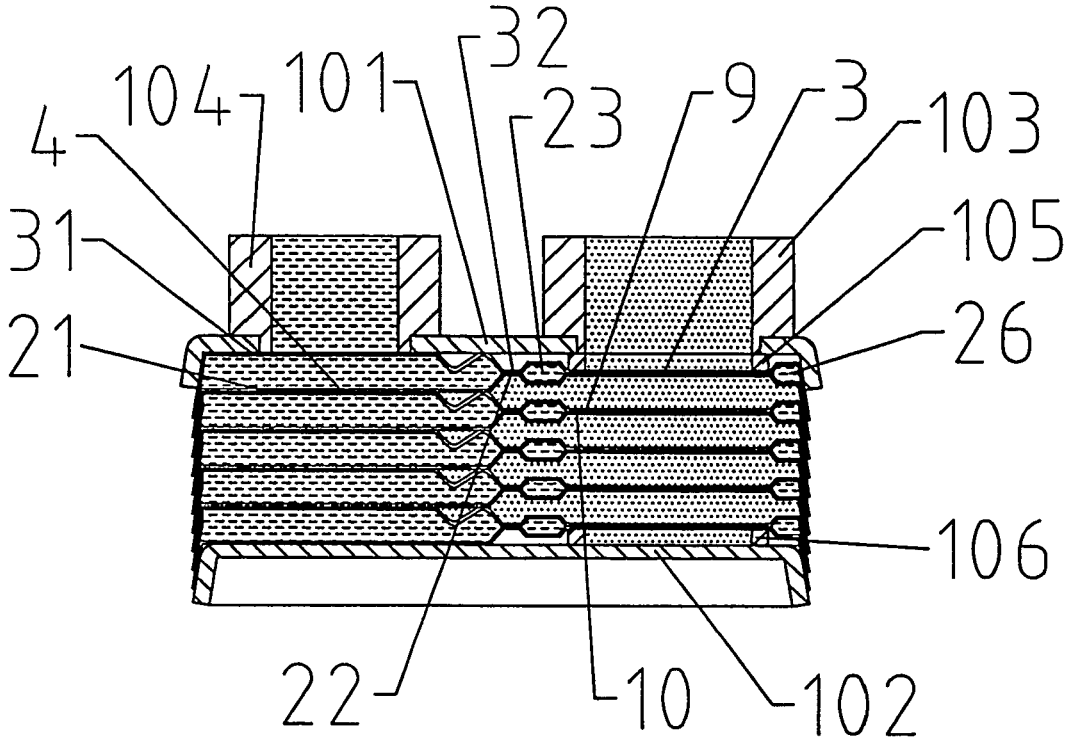

FIG. 4 is a vertical section through a heat exchanger according to the invention—the section being taken along the lines X-X in FIGS. 2 and 3. The exchanger shown hasten channel forming plates of thin metal plate soldered together at areas and points where they are contacting each other. As shown in FIG. 4 the exchanger is provided with heavier end plates—an upper end plate 101 and a lower end plate 102. The upper end plate 101 carries fittings 103, 104 for connections to a source for providing the hot gas flow respectively for draining heated cooling water. The reference numerals 105 and 106 are used for distance rings. The heat exchanging flows are provided with different hatchings.

It will be understood that the channels 23 and 26 for cooling water will be located near soldered connections and plate parts exposed to flow of hot gas, e.g. the flanges formed by the ring shaped areas 10 of the channel forming plates and thus lower the maximum temperature of the soldering material and the material in the flanges.

Figure 5:
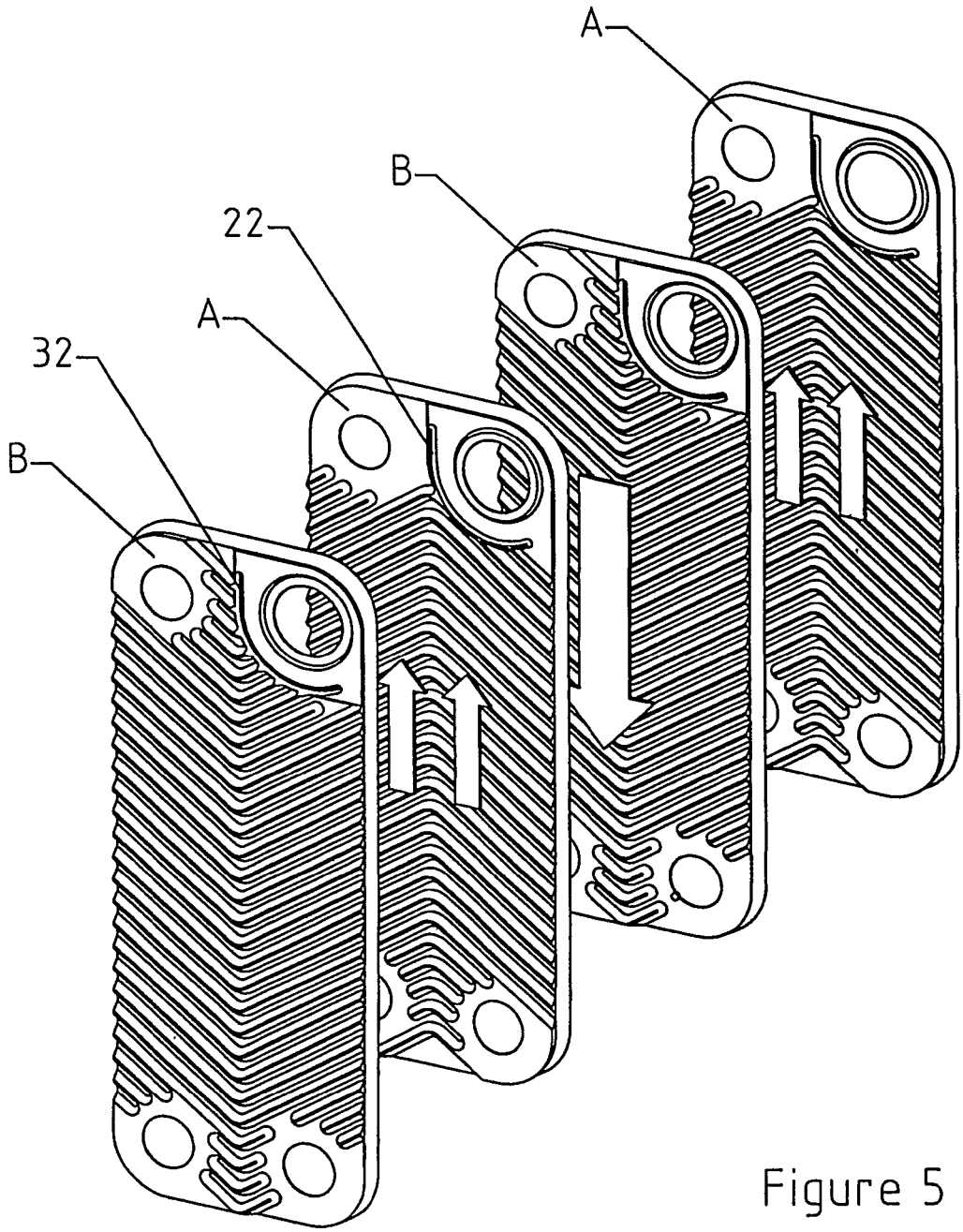

It should also be understood that the height of the channels 23 and 26 established by depressions in the plates near the area 10 should be less than the height of the ridges 22 or the depressions 32 in order not to block the flow of high temperature medium FIG. 5 shows separately and drawn apart some of the channel forming plates of FIG. 4. The plates having the shape corresponding to the plate shown in FIG. 2 have been marked A and the plates corresponding to those of FIG. 3 are marked B. The height of a curved ridge 22 of the plate type A and of the corresponding curved depression 32 of a plate type B should be equal to the height of a ridge of the chevron pattern 2 of the plates. The flows of hot gas and of cooling water have been shown with double respectively with single arrows.

It will be understood that the device described above and shown in the FIGS. 2-5 may be used for other heat exchanging purposes than boilers for heating dwelling houses. It may be used advantageously for any application in which one of the heat exchanging flows is a hot fluid having such high temperature that it might be detrimental to materials located near port holes entered by the hot fluid.

Figure 6:
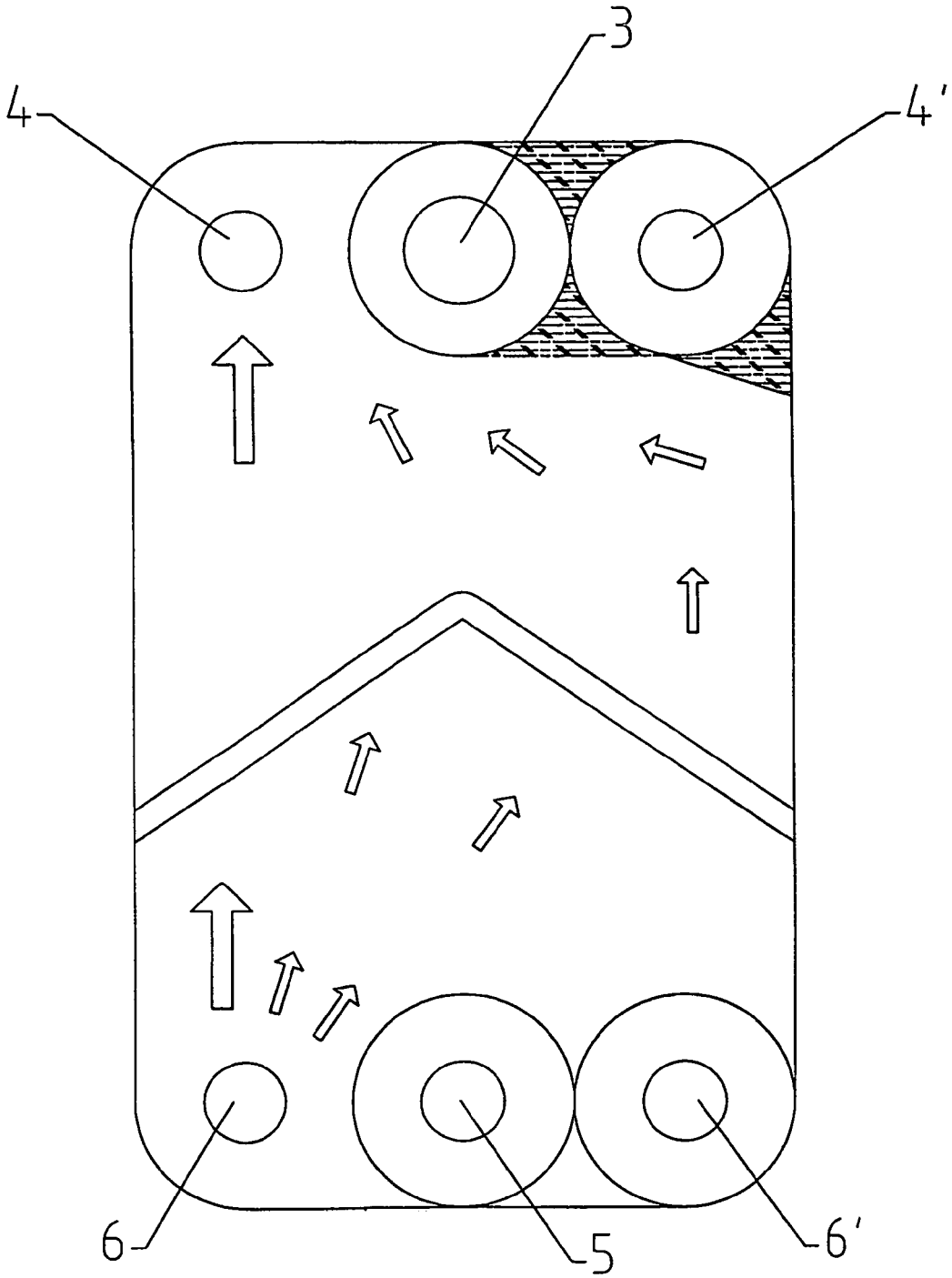
FIG. 6 is a plan view of a heat exchanger plate of a three-circuit heat exchanger corresponding to the plate shown in FIG. 1.

The FIGS. 2-5 show the invention being applied to a two-circuit heat exchanger. FIG. 6 shows the problem of cooling the plate flanges extending into an inlet opening for a hot fluid used in a three-circuit heat exchanger. A known exchanger of this type has been described e. g. in the U.S. Pat. No. 6,305,466. In this type of exchanger a heating fluid is cooled by two separate low temperature fluids. Each of the two cooling flows is limited by pairs of plates interconnected by soldering around port holes for the heating fluid and forming flanges extending into the port holes for the heating fluid. Normally the inlet and the outlet for the heating fluid is arranged between the outlets resp. the inlets for the two cooling fluids. It will be understood that the flow of cooling fluid between its inlet 6 and its outlet 4 will be rather slow in the area indicated by hatching.

Figure 7:
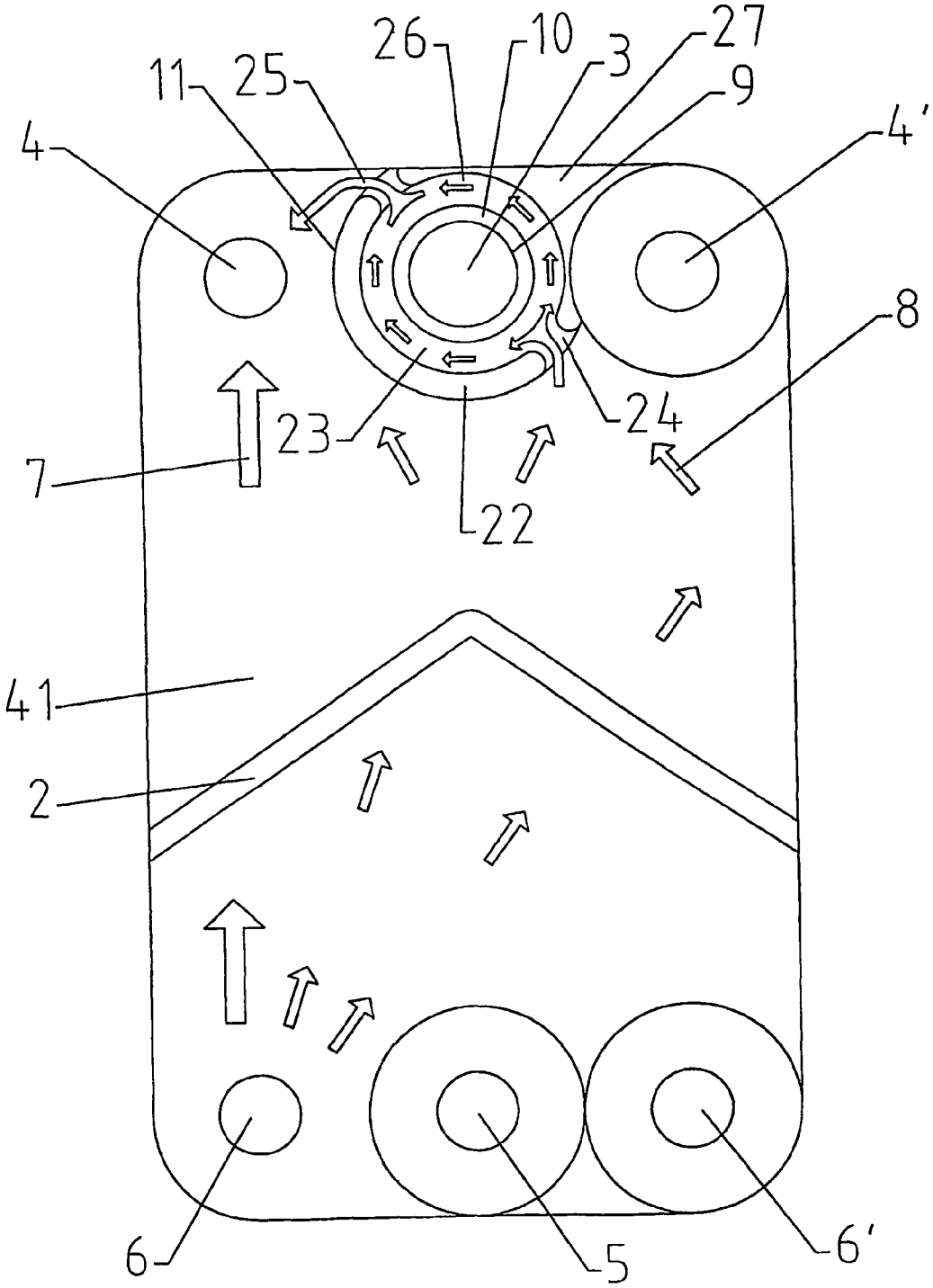
FIG. 7 is a plan view of a heat exchanger plate of a three-circuit heat exchanger according to the invention showing how the cooling of plate flanges in the inlet for a hot fluid may be improved relative the embodiment of FIG. 6.

As shown in FIG. 7 separate channels 23 and 26 having common inlets and outlets 24 resp. 25 may be provided and partly limited by a ridges 22. Thus the cooling of the plate area 10 forming flanges extending into the inlet port 3 of the hot fluid will be improved in a way similar to the cooling referred to above in connection with the explanation of the FIGS. 2-5. The area designated by 27 is a plate area pressed to the height of the ridge 22. It should be noted that the area 27 need not be specially cooled.

Figure 8:
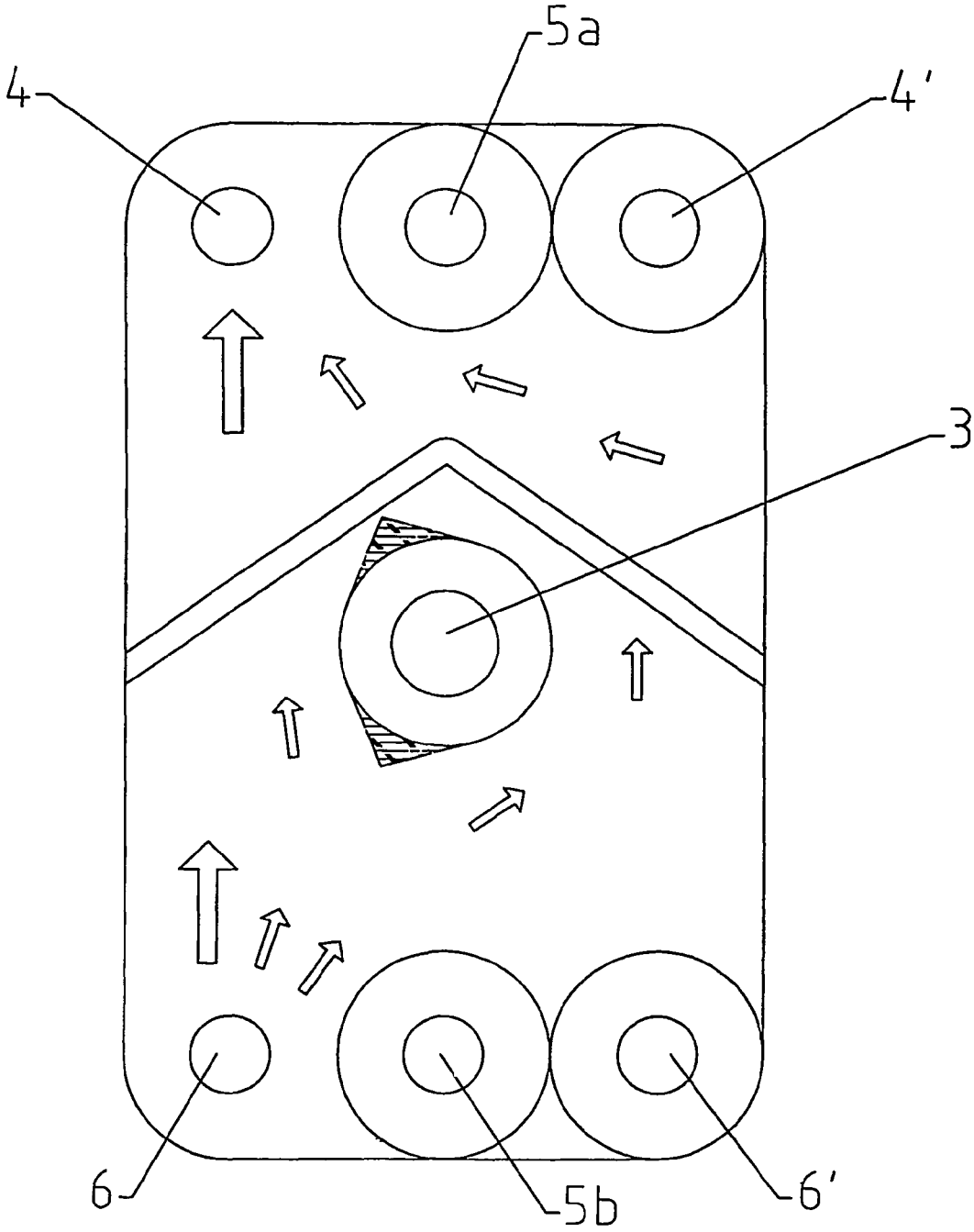
FIG. 8 is a plan view of a heat exchanger plate of a three-circuit heat exchanger having a central inlet for a heating fluid.

FIG. 8 shows a plate of a three-circuit heat exchanger in which a heating flow having a central inlet port 3 and two outlet ports 5*a* and 5*b* is exchanging heat with two cooling flows having inlets 6, 6' and outlets 4, 4'. The cooling flow will be rather poor along the hatched areas in FIG. 8.

Figure 9:
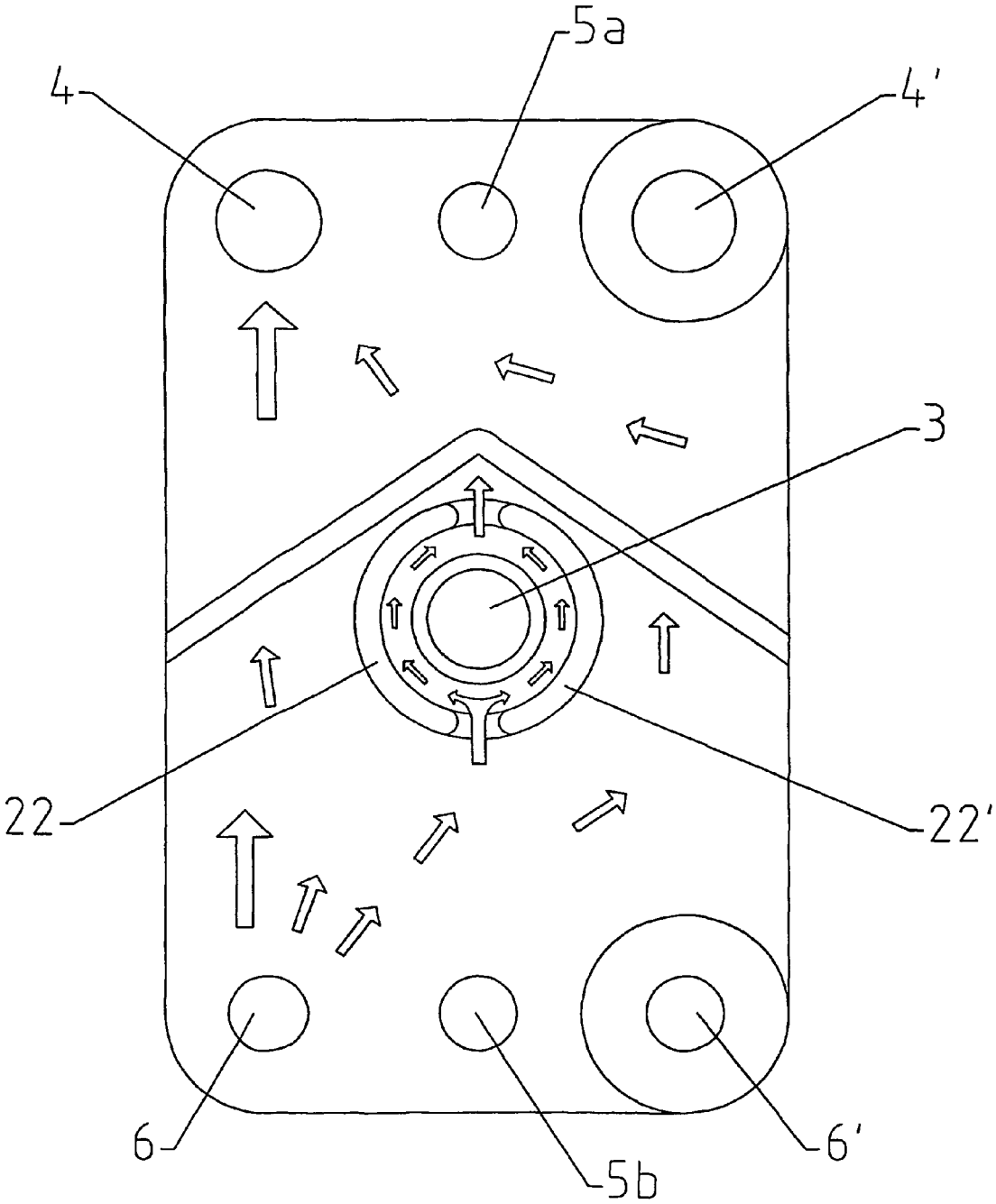
FIG. 9 is a plan view of a heat exchanger plate of a three-circuit heat exchanger according to the invention showing how the cooling of plate flanges in the inlet for a hot fluid may be improved relative the embodiment of FIG. 8.

As shown in FIG. 9 the cooling flow could be improved around the inlet 3 of the heating fluid by providing channels 23 and 26 having a common inlet 24 and a common outlet 25 and being partly limited by ridges 22 and 22'.

Figure 10:
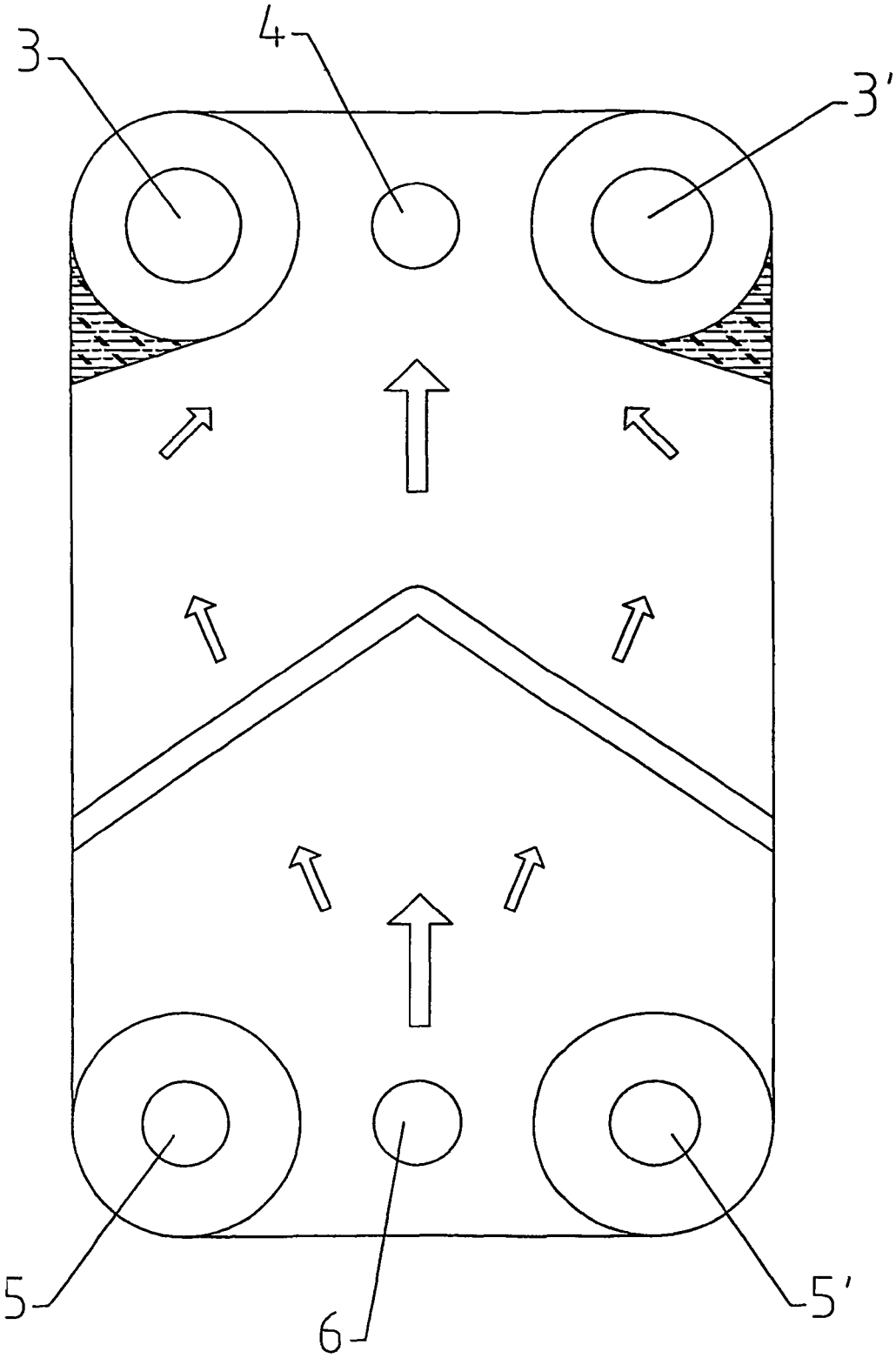
FIG. 10 is a plan view of a heat exchanger plate of a three-circuit heat exchanger in which heat is exchanged between one cooling fluid and two heating fluids.

FIG. 10 shows the problem of cooling the two inlets for a heating fluid of a three-circuit heat exchanger having a single cooling fluid for cooling two heating fluids. The hatched areas shown in FIG. 10 indicate areas with poor cooling due to low velocity of the cooling fluid.

Figure 11:
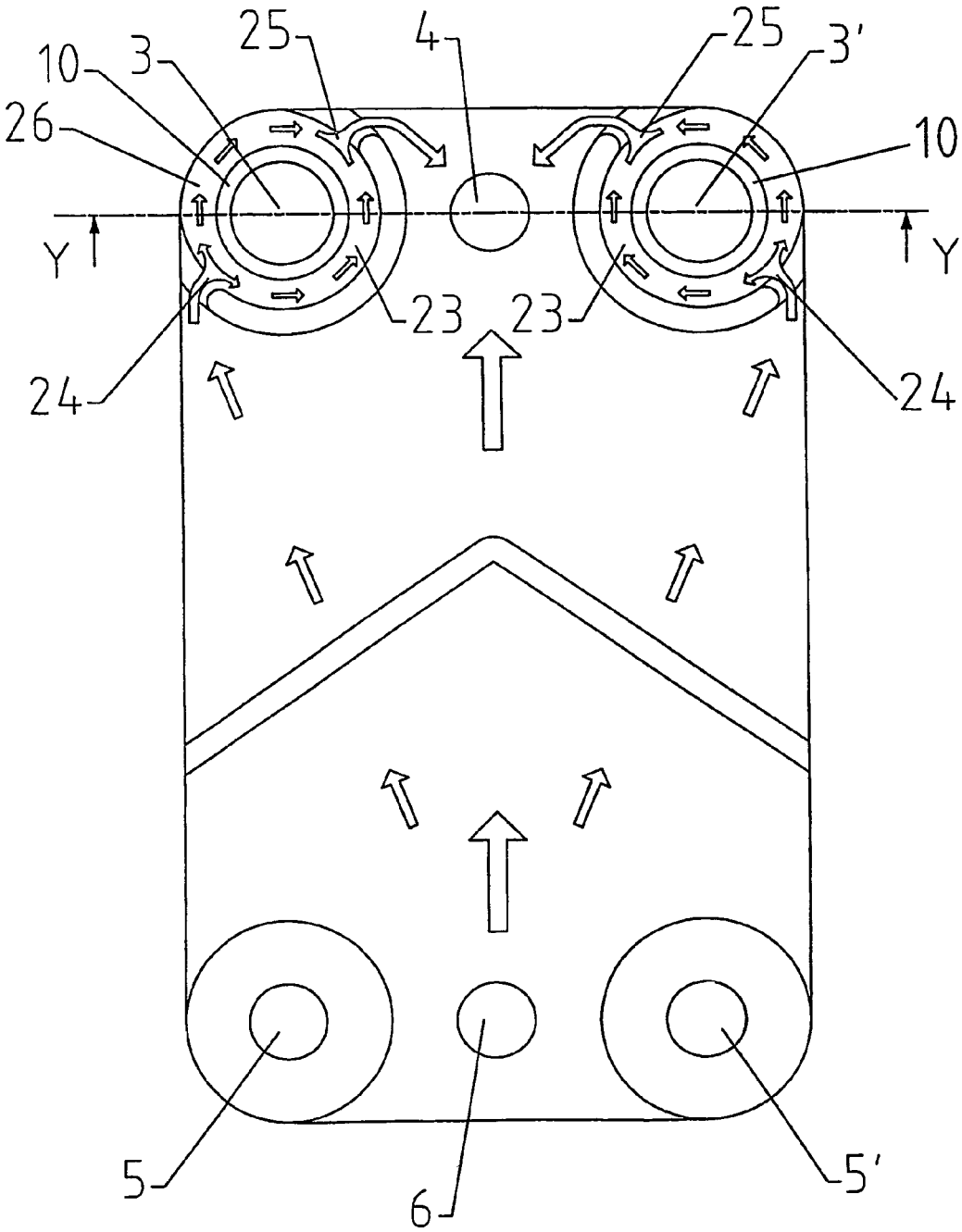
FIG. 11 is a plan view of a heat exchanger plate of a three-circuit heat exchanger according to the invention showing how the cooling of plate flanges in the inlets for two heating fluids may be improved relative the embodiment of FIG. 10.

FIG. 11 shows how the cooling could be improved in a manner similar to that of the previous described embodiments of the invention. Similar features have been provided with corresponding reference numerals. For better understanding FIG. 12 shows a vertical section along the line Y-Y of FIG. 11.

Figure 12:
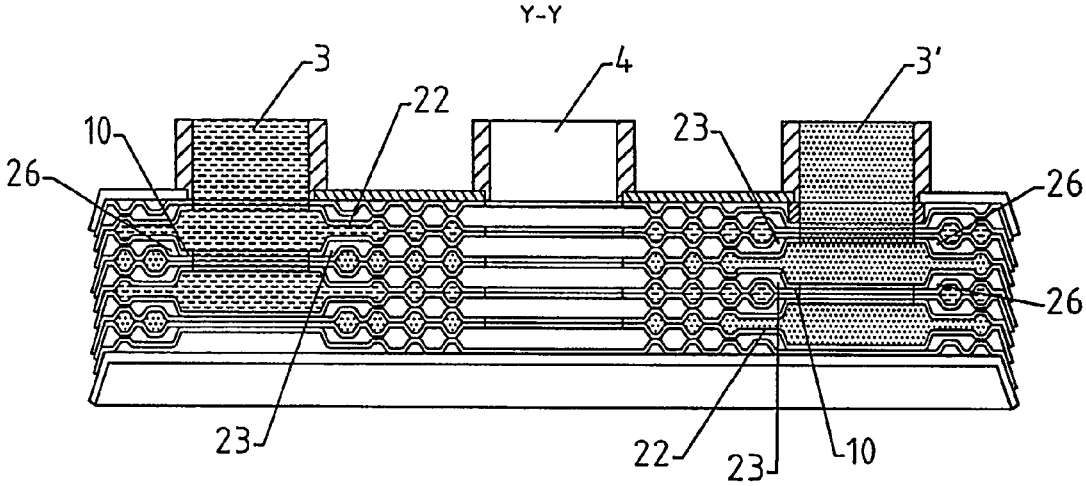
FIG. 12 is a vertical section along the line Y-Y in FIG. 11.

In FIG. 12 each of the two heating fluids as well as the single cooling fluid are provided with a special hatching. The channels 23 and 26 are close to the flanges 10. Each flange consists of four plate parts soldered together.

The invention claimed is:

1. A plate heat exchanger adapted to exchange heat between at least one high temperature fluid and at least one cooling fluid comprising a plurality of stacked heat exchanger plates, each plate comprising: (a) an inlet opening for the high temperature fluid, (b) an outlet opening for the cooling fluid, (c) an outlet opening for the high temperature fluid and (d) an inlet opening for the cooling fluid, the stacked heat exchanger plates limiting channels for at least two heat exchanging fluids, and pairs of said plates limiting channels for a cooling fluid are soldered together along contact areas to form flanges extending into the inlet of flow of the high temperature fluid, wherein two separate channels for the cooling fluid are provided adjacent to said contact areas forming a flange extending into the flow of said high temperature fluid passing through the inlet opening, said two separate channels for the cooling fluid being provided with a common inlet and with a common outlet, the common inlet being located at a higher flow pressure position than that of the said common outlet, one of said channels being partly limited by a pressed ridge in one of the plates forming said pairs of plates limiting said channels for the cooling fluid, said pressed ridge being adapted to contact a corresponding ridge on another plate in said pair of plates, said one channel adjacent to said pressed ridge having less height than said pressed ridge; and wherein in each heat exchanger plate, said inlet opening for the flow of the high temperature fluid is of a larger area than that of the outlet opening for said high temperature fluid.

2. A plate heat exchanger according to claim 1, wherein said high temperature fluid is a gas.

3. A plate heat exchanger according to claim 1, wherein each said heat exchanger plate is substantially rectangular in shape and each said inlet opening and each said outlet opening for each said heat exchanging fluid is placed near corners thereof.

4. A plate heat exchanger according to claim 1, wherein said heat exchanger is designed for three heat exchanging fluids: (i) one high temperature heating fluid and (ii) two cooling fluids.

5. A plate heat exchanger according to claim 4, wherein the inlet opening of the heating fluid is positioned remote from the inlet opening and the outlet opening for one of the two cooling fluids.

6. A plate heat exchanger according to claim 1, wherein said heat exchanger is designed for three heat exchanging fluids: (i) two heating fluids and (ii) one cooling fluid, the inlet opening and the outlet opening for the two heating fluids being positioned on both sides of the inlet opening and the outlet opening for the cooling fluid.

* * * * *